US005630910A

United States Patent [19]

McPherson

[11] Patent Number: 5,630,910

[45] Date of Patent: May 20, 1997

[54] CLIP FASTENER FOR A DEWATERING BOX

[75] Inventor: Douglas R. McPherson, Windsor, Conn.

[73] Assignee: JWI Ltd., Ottawa, Canada

[21] Appl. No.: 494,816

[22] Filed: Jun. 26, 1995

[51] Int. Cl.[6] ..... D21F 1/54

[52] U.S. Cl. ..... 162/352; 162/374; 162/272

[58] Field of Search ..... 162/352, 374, 162/272; 24/460, 461, 462; 403/400, 391, 397

[56] References Cited

U.S. PATENT DOCUMENTS

| | | | |
|---|---|---|---|
| 3,337,394 | 8/1967 | White et al. | 162/352 |
| 3,535,204 | 10/1970 | Truxa | 162/352 |
| 3,837,258 | 9/1974 | William | 85/75 |
| 3,928,125 | 12/1975 | Poeschel | 162/352 |
| 4,214,949 | 7/1980 | Schiel | 162/352 |
| 4,319,957 | 3/1982 | Bartelmuss | 162/352 |
| 4,321,108 | 3/1982 | Goddard | 162/352 |
| 4,443,298 | 4/1984 | Thorpe | 162/352 |
| 4,559,105 | 12/1985 | Sennett et al. | 162/352 |
| 4,957,598 | 9/1990 | Corbellini | 162/363 |
| 5,011,577 | 4/1991 | Hansen et al. | 162/352 |
| 5,076,894 | 12/1991 | Simmons et al. | 162/352 |
| 5,089,090 | 2/1992 | Hansen | 162/351 |

FOREIGN PATENT DOCUMENTS

| | | | |
|---|---|---|---|
| 3195 | 7/1979 | European Pat. Off. . | |
| 306458 | 3/1989 | European Pat. Off. . | |
| 0350827 | 7/1989 | European Pat. Off. | D21F 1/52 |
| 758979 | 10/1954 | United Kingdom . | |
| 1287761 | 9/1972 | United Kingdom . | |
| 2037862 | 7/1980 | United Kingdom . | |
| 2066892 | 6/1981 | United Kingdom . | |

OTHER PUBLICATIONS

Derwent WPI 79–G4027B/30; Abstract of EP 3195 in English, 1979.

Derwent WPI 89–070617/10; Abstract of EP 306,458 in English, 1989.

*Primary Examiner*—Karen M. Hastings

*Attorney, Agent, or Firm*—Robert A. Wilkes

[57] ABSTRACT

Clip type fasteners for attaching paper machine fabric contacting elements to their supporting structures. The fasteners are provided typically with two tight tolerance slots, which are press-fits onto the elements and the support structure. The fasteners allow for simple removal, replacement, and respacing of the elements.

25 Claims, 3 Drawing Sheets

CLIP FASTENER FOR A DEWATERING BOX

FIELD OF THE INVENTION

The invention relates to a clip fastener for releasably attaching fabric contacting elements to the supporting structure of a dewatering box, such as a suction box, in paper making machines.

BACKGROUND OF THE INVENTION

Dewatering boxes are used in paper making machines for the removal of water. These boxes comprise stationary fabric contact elements, such as foils and blades, with gaps between them and a support structure so that the fabric contact elements are accurately located. It is frequently necessary to change these stationary fabric contact elements. The supporting structures currently in use do not allow for the quick and easy replacement or respacing of these elements in response to changes in paper making conditions.

As used herein, the following terms have certain meanings.

"Machine direction" refers to a line parallel to the direction of travel of the paper making fabric, and "cross-machine direction" refers to a direction perpendicular to this.

"Paper side" refers to the side of a component in the paper making machine which faces toward the paper making fabric.

"Machine side" refers to the side of a component that faces toward the paper making machine.

"Dewatering box" is used to refer to units which include static means for withdrawing water from the fabric and/or the paper web.

The known dewatering boxes have a supporting structure including machine direction support members upon which the fabric support elements are securely located. The support structure either forms an integral part of the dewatering box, or is fastened to it.

DISCUSSION OF THE PRIOR ART

A variety of mounting means are known for locating fabric contacting elements on the supporting structure. The main disadvantage of the known means is that the fabric contacting elements are ultimately attached to a supporting rail which is fixed in position on the dewatering box by bolting, welding, clamping or the like. The supporting structure cannot be easily modified, especially to respace the elements.

The prior art does not disclose a simple fastening means whereby all of the fabric contacting elements forming the cover of a dewatering box are easily replaceable, and the machine direction spacing of the fabric contact elements can be readily and accurately modified without also changing the support structure.

SUMMARY OF THE INVENTION

According to the invention, there is provided a clip fastener for attaching fabric contacting elements to the supporting structure of a dewatering box. The fasteners have at least one paper side slot which is shaped to match a fabric contacting element, and at least one machine side slot that is shaped to match a support member. Both mating slots are of tight tolerance and provide interlocking of the fabric contact element(s) and the support structure members. The fasteners allow for simple removal and accurate replacement of the fabric contacting elements, as well as modifications to their machine direction spacing.

The fasteners, fabric contact elements and support structure members are accurately dimensioned and are shaped so the fasteners securely lock the fabric contacting elements onto the support structure. Preferably the fastener slots are provided with internal "V" shaped projections engaging grooves on the elements and the members.

To instal a fabric contact element, the fasteners are attached along its length at intervals matching the support members. The element is installed by engaging the fasteners onto the support members. The element, along with the fasteners, is removed from the support member by releasing the fasteners, in a vertical direction.

Each fastener can accommodate one or more elements. If multi-element fasteners are used, all of the elements are first installed on the fasteners, and the fasteners are then engaged to the support structure.

The machine direction spacing of the elements may be varied by inserting spacers between the fasteners, or by inserting fasteners having different machine direction lengths. Conveniently the spacers have the same shape as the fasteners, and both are conveniently manufactured in a variety of lengths. It will sometimes be convenient to use additional fasteners as spacers.

The fasteners are conveniently manufactured from one of the following materials: ultra-high molecular weight polyethylene, poly(etheretherketone), poly(phenylene sulphide), stainless steel or other materials which will not degrade readily during prolonged exposure in the paper making environment. The plastic materials may also contain reinforcement, such as fibre glass.

Thus, in a first embodiment, the present invention seeks to provide a releasable clip fastener, for attaching at least one paper making fabric contacting element oriented in the cross machine direction to at least one support structure member of a paper making machine dewatering box oriented in the machine direction including:

i) at least one first slot having side faces having first mating means configured to engage with second cooperating mating means on the at least one element; and ii) at least one second slot having side faces having third mating means configured to releasably engage with fourth cooperating mating means on the at least one member.

Preferably, the at least one first slot having side faces having first mating means is configured to releasably engage with the second cooperating mating means on the at least one element.

Preferably, the fastener includes at least one first slot, and one second slot. More preferably, the fastener includes one first and one second slot.

In a second broad embodiment of the invention, there is provided a paper making machine dewatering box including:

(1) at least one releasable clip fastener, for attaching at least one paper making fabric contacting element oriented in the cross machine direction to at least one support structure member oriented in the machine direction including:

i) at least one first slot having side faces having first mating means configured to engage with second cooperating mating means on the at least one element; and ii) at least one second slot having side faces having third mating means configured to releasably engage with fourth cooperating mating means on the at least one member;

(2) at least one fabric contacting element oriented in the cross machine direction having second mating means on opposed side faces extending in the cross machine direction; and (3) at least one support member oriented in the machine direction having fourth mating means on opposed side faces extending in the machine direction.

Preferably, the dewatering box includes a plurality fasteners attaching together a plurality of elements and a plurality of members, and wherein the fasteners are engaged abutting each other on the member.

Preferably the dewatering box includes fasteners all having the same machine direction length. Alternatively, the dewatering box includes fasteners of differing lengths. As a further alternative, the dewatering box includes spacers attached to at least one member between at least two fasteners. As yet another alternative, the dewatering box includes at least one fastener attached to only one member between at least two fasteners attached to elements. By choosing the fastener length, and by inserting either spacers or blank fasteners the machine direction spacing of the elements is readily controlled.

Preferably, in the dewatering box the fasteners include at least one first slot, and one second slot. More preferably, in the dewatering box the fasteners include one first and one second slot.

Preferably, in the dewatering box the second mating means extends for the length of the element. Preferably, in the dewatering box the fourth mating means extends for the length of the member.

Preferably, in the dewatering box the first mating means is configured to releasably engage the second mating means.

In these Figures, the arrows "A" indicate the machine direction, and the arrows "B" indicate the cross-machine direction. For clarity, both the fabric supporting faces of the elements, and the lower parts of the dewatering box, are not shown.

DETAILED DESCRIPTION OF THE DRAWINGS

Figure 1:
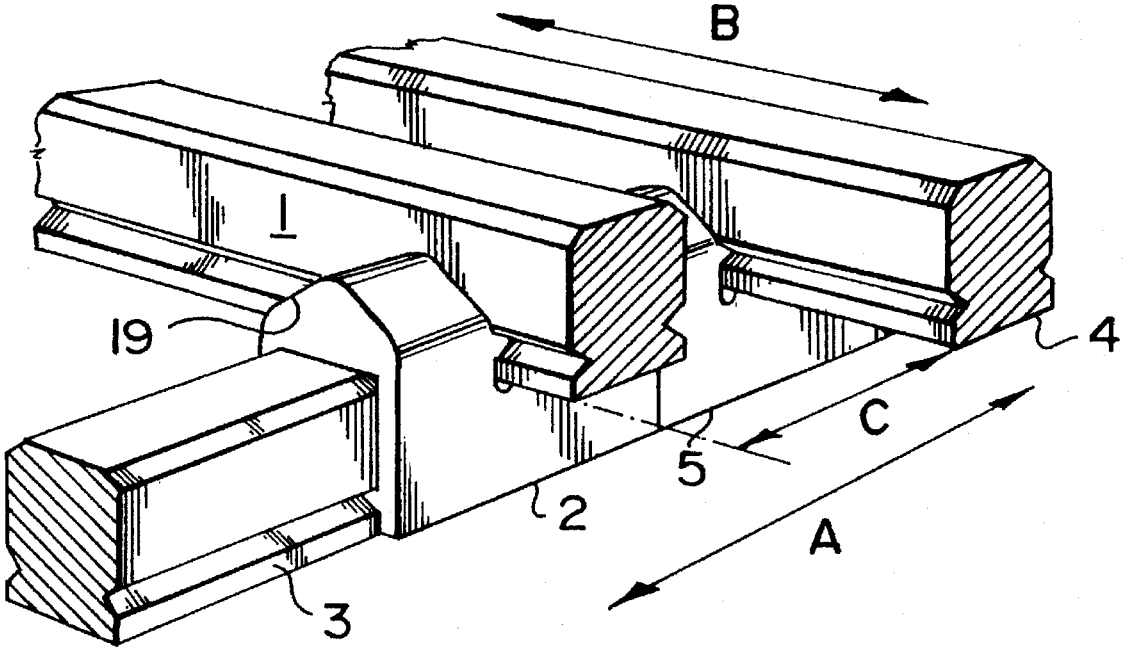
FIG. 1 shows a fastener installed into a dewatering box.

FIG. 1 shows one embodiment of a fastener 2 engaging a fabric contact element 1 and a support member 3 of the supporting structure of a dewatering box. The element 1 extends in the cross-machine direction the full width of the paper machine. A second element 4 is attached to the same member 3 by a second fastener 5. The spaces between the elements provide air- and water-accessible gaps. In an assembled dewatering box there are several elements 1,4 supported by several members 3.

The fasteners 2 and 5 securely interlock the elements 1 and 4 to the member 3 by engaging the opposed side faces of the elements 1, 4 and of the member 3. The machine direction spacing C of subsequent elements may be varied by using blank fasteners, by employing fasteners having differing lengths, or by using spacers which engage with the member 3, or even a combination of these.

FIGS. 2, 3, 4 and 5 show the fasteners 2. The slot 6 is designed to engage element 1. Two different first and second mating means are shown.

Figure 2:
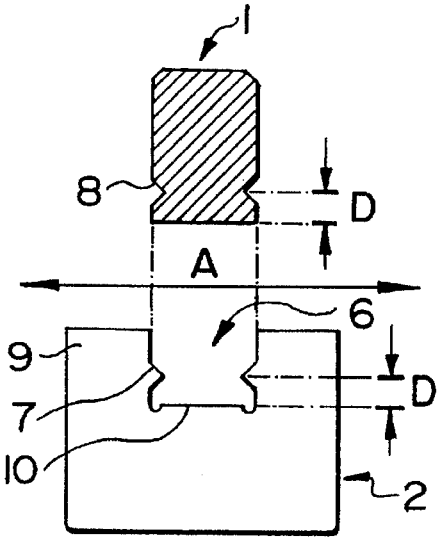
FIG. 2 shows a cross machine side view of a fastener.
Figure 3:
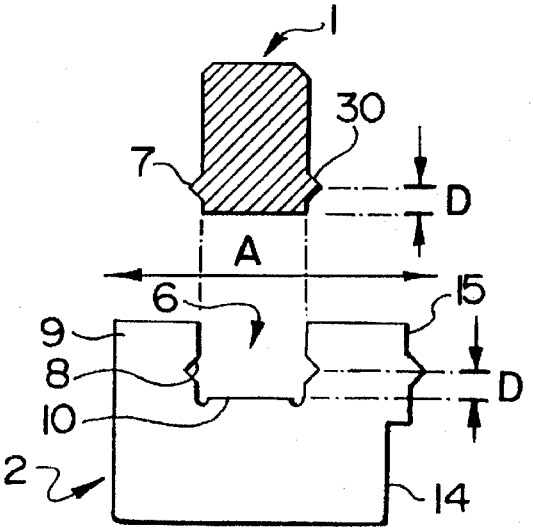
FIG. 3 and 4 show a cross machine side views of an alternate versions of the fastener.

In FIGS. 2 and 3 the "V" shaped projections 7 engage corresponding "V" shaped notches 8. In each case the distance "D" on the element is equal to the same distance "D" in the slot, so that the projections securely engage into the notches. The fastener 2 is installed on the element 1 by snapping it into place so that the element 1 rests on the floor 10. The fastener can be released from the element by pushing it out of engagement with the slot 6. In practise it has been found that the arrangement in FIG. 2 is preferable for both the element and the member (see FIG. 5), since the required notch is easily made by machining a groove into the opposed side faces of the element 1 (or a member 3). If desired, the groove need only be cut in the regions where the fasteners are to be used. As shown in FIG. 3 it is possible to provide the projection 7 as an inserted rib 30 in the element 1; the same method can be used in a member 3.

Figure 4:
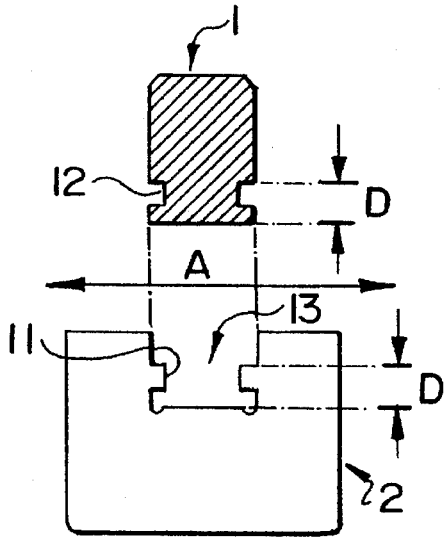

In FIG. 4, the square shape of the matching projections 11 and notches 12 precludes releasable engagement of the element 1 into the slot 13. Other releasable and non-releasable notch and projection shapes are possible. The fastener FIG. 4 is slid along the element 1 to the desired position. The distances D again are equal.

FIG. 3 also shows a fastener for use at the ends of the support members, adjacent a machine direction edge of the dewatering box. The lateral edge is modified to engage with the leading or trailing elements of the dewatering box, and as shown is provided with a recess 14 and a mating projection 15 for this purpose. This is shown in greater detail in FIG. 6.

Figure 5:
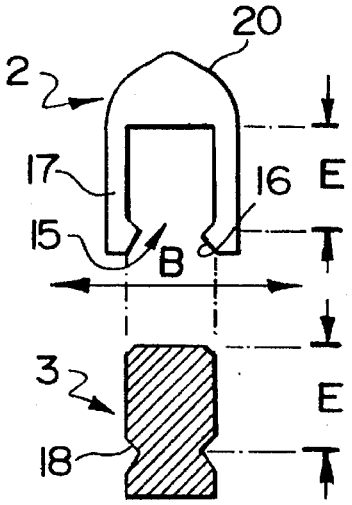
FIG. 5 shows a machine direction side view of a fastener.

FIG. 5 shows the third and fourth mating means of the fastener of FIGS. 2,3, and 4. The slot 15 is designed to engage the member 3. The slot 15 has internal "V" shaped projections 16 on the arms 17 for engagement with the "V" shaped notch 18 of the support member 3. The depth "E" of the slot 15 is equal to the height "E" of the matching profile of the support member 3. The positions of the notches and projections can be reversed, as discussed above. When installed on the member, the fastener, and an element engaged into the other slot, is held firmly in place on the member so that it cannot rock or move laterally due to the tension created between the element 1, the fastener 2 and the support member 3. The paper side surfaces 19 and 20 of the fastener 2 shown in FIGS. 1 and 5 are each shaped so as not to obstruct the flow of water into the dewatering box from the paper making fabric.

The slots 6, 13, and 15 should be accurately dimensioned so as to hold both the element 1 and the member 3 without moving. A tolerance of about 0.002 cm (about 0.001 inch) appears to be sufficient. The machine direction length of the fasteners can be used to vary the element-to-element spacing, and hence is determined in conjunction with the particular application and paper making conditions. As noted above, spacers can also be used to set the element spacing, as is shown in FIG. 6.

Figure 6:
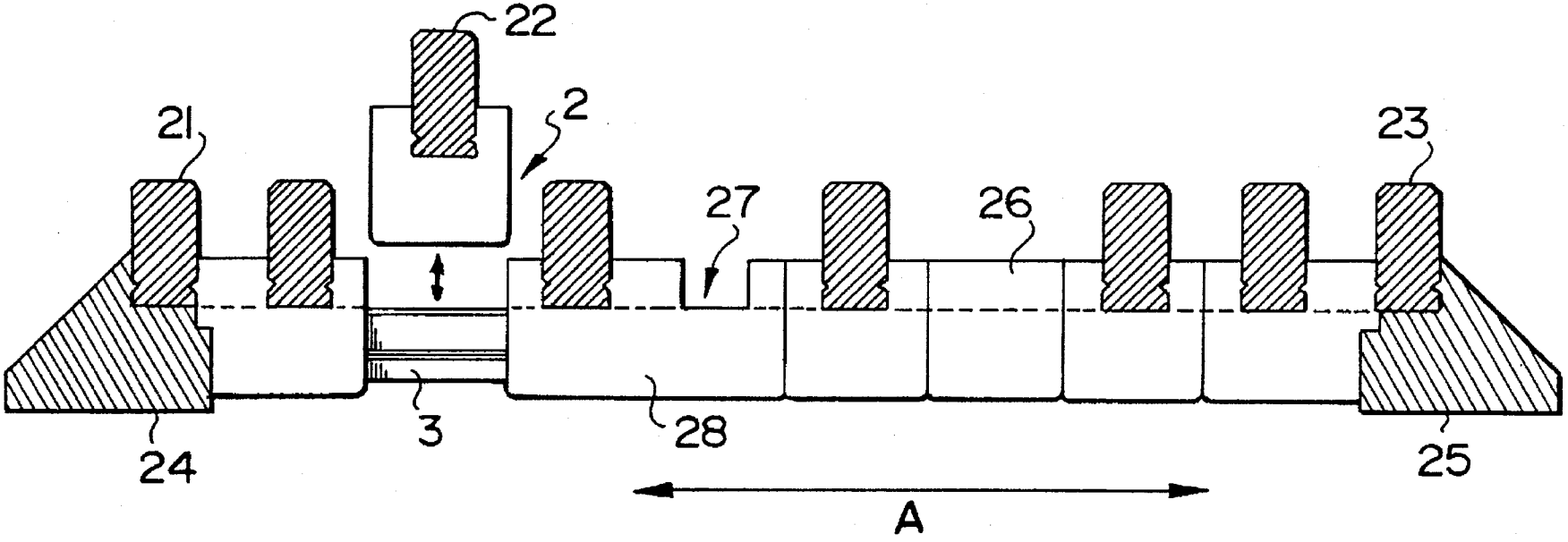
FIG. 6 shows a cross-machine direction view of several elements assembled onto a support member.

FIG. 6 is a cross-machine direction view in which several elements 21 have been installed, and another 22 is ready for installation, into the fasteners 2. At each end fasteners as shown in FIG. 3 abut with the end elements 21 and 23, and with the support structure frame members 24 and 25. In this Figure the notches and projections are omitted for clarity: they are the same as those shown above. This Figure shows how the element-to-element spacing can be controlled. If each fastener has the same machine direction length, the spacing of the fabric contact elements is always equal. This spacing can be readily modified, if required, simply by mixing fasteners of differing machine direction length, by inserting a spacer as at 26, or by leaving out an element, as at 27. The fastener 28 with the blank space 27 is also twice the length of the other fasteners. The spacer 26 is essentially the same as the fastener 2, the only difference being the absence of a slot into which an element can be inserted. As shown the spacer is the same length as a fastener: a spacer can be any desired length.

I claim:

1. A paper making machine dewatering box having a papermaking fabric support surface comprising a plurality of releasable clip fasteners, a plurality of static paper making fabric supporting elements, and a plurality of support members, wherein:

(1) each releasable clip fastener releasably interlocks at least one static paper making fabric contacting element oriented in the cross machine direction to a support structure member oriented in the machine direction, the clip fastener including:

(i) at least one first slot having side faces having first mating means engaged with second cooperating mating means on the or each element; and (ii) at least one second slot having side faces having third mating means releasably engaged with fourth cooperating mating means on the member constructed and arranged such that the clip fastener can be engaged downwardly and disengaged upwardly from the member;

(2) each fabric support element oriented in the cross machine direction has its second mating means engaged with the clip fasteners on opposed side faces thereof extending in the cross machine direction;

(3) each support member oriented in the machine direction has its fourth mating means engaged with the clip fasteners on opposed side faces thereof extending in the machine direction;

(4) the mutual dimensional tolerances between the first and the second mating means, and between the third and the fourth mating means are each such that the element is held firmly in place without moving, and without the use of any other fastening means;

(5) the machine direction spacing of the elements is determined by the machine direction length of a spacing means located between the fasteners, and (6) the spacing means is chosen from the group consisting of (a) a spacer having a third slot having side faces having fifth mating means releasably engaged with the fourth cooperating mating means; (b) a clip fastener as defined above but engaged only with the member and not engaged with an element; and (c) a clip fastener as defined above but having additionally a different machine direction length.

2. A dewatering box according to claim 1 wherein the element spacing is determined by the machine direction length of the fasteners; the fasteners include the spacing means; and the fasteners together with the included spacing means all have the same machine direction length.

3. A dewatering box according to claim 1 wherein the element spacing is determined by the machine direction length of the fasteners; the fasteners include the spacing means; and the fasteners together with the included spacing means do not all have the same machine direction length.

4. A dewatering box according to claim 1 wherein the spacing means is option (b) of clause (6) of claim 1.

5. A dewatering box according to claim 1 wherein the spacing means is option (a) of clause (6) of claim 1.

6. A dewatering box according to claim 1 wherein the fastener includes at least one first slot, and one second slot.

7. A dewatering box according to claim 1 wherein the fastener includes one first slot and one second slot.

8. A dewatering box according to claim 1 wherein the second mating means extends for the length of the element.

9. A dewatering box according to claim 1 wherein the fourth mating means extends for the length of the member.

10. A dewatering box according to claim 1 wherein the first mating means is releasably engaged with the second mating means.

11. A dewatering box according to claim 1 wherein the first mating means and the second mating means comprise cooperating projections and notches.

12. A dewatering box according to claim 1 wherein the third mating means and the fourth mating means comprise cooperating projections and notches.

13. A dewatering box according to claim 1 wherein the first mating means together with the second mating means, and the third mating means together with the fourth mating means, each comprise cooperating projections and notches.

14. A dewatering box according to claim 11 wherein the first mating means comprises projections, and the second mating means comprises notches.

15. A dewatering box according to claim 12 wherein the third mating means comprises projections, and the fourth mating means comprises notches.

16. A dewatering box according to claim 13 wherein the first mating means and the third mating means each comprise projections, and the second mating means and the fourth mating means each comprise notches.

17. A dewatering box according to claim 14 wherein the projections and notches are "V" shaped.

18. A dewatering box according to claim 15 wherein the projections and notches are "V" shaped.

19. A dewatering box according to claim 10 wherein the first and second mating means comprise cooperating projections and notches.

20. A dewatering box according to claim 10 wherein the third and fourth mating means comprise cooperating projections and notches.

21. A dewatering box according to claim 19 wherein the first mating means comprises projections, and the second mating means comprises notches.

22. A dewatering box according to claim 20 wherein the third mating means comprises projections, and the fourth mating means comprises notches.

23. A dewatering box according to claim 21 wherein the projections and notches are "V" shaped.

24. A dewatering box according to claim 22 wherein the projections and notches are "V" shaped.

25. A dewatering according to claim 1 wherein the static paper making fabric support elements are chosen from the group consisting of a foil and a blade.

* * * * *